US005846212A

United States Patent [19]

Beeuwkes, III et al.

[11] Patent Number: 5,846,212

[45] Date of Patent: Dec. 8, 1998

[54] PASSIVE MANDIBLE TRANSLATOR

[75] Inventors: Reinier Beeuwkes, III, Concord, Mass.; Harold E. Clupper, West Chester, Pa.

[73] Assignee: Therabite Corporation, Newton Square, Pa.

[21] Appl. No.: 623,921

[22] Filed: Mar. 28, 1996

[51] Int. Cl.[6] ..... A63B 23/03

[52] U.S. Cl. ..... 601/38; 482/11

[58] Field of Search ..... 601/1, 23, 5, 38, 601/85, 97; 482/10, 11; 128/861, 862; 433/6, 69, 229; 602/17; 600/23

[56] References Cited

U.S. PATENT DOCUMENTS

| | | | |
|---|---|---|---|
| 4,700,695 | 10/1987 | Davis et al. | 482/11 |
| 4,883,046 | 11/1989 | Fontenot | 482/11 |
| 4,955,367 | 9/1990 | Homsy | 482/11 |
| 5,035,420 | 7/1991 | Beeuwkes, III et al. | 482/11 |
| 5,176,594 | 1/1993 | Lee | 482/11 |
| 5,374,237 | 12/1994 | McCarty, Jr. | 601/38 |

*Primary Examiner*—Jeanne M. Clark
*Attorney, Agent, or Firm*—Bush, Riddle & Jackson, LLP

[57] ABSTRACT

A translator apparatus for achieving omnidirectional translation of the mandible of a human patient and having a maxillary translation plate having a maxillary mouthpiece thereon for temporarily fixing the maxillary dentition of a patient thereto. A mandibular translation plate is provided, also having a mandibular mouthpiece for temporary fixation with the mandibular dentition of the patient and the mandibular element. A translation control plate is interposed between the maxillary and mandibular translation plates and establishes linearly moveable guiding relation with elongate guide slots of both the maxillary and mandibular plates. The guide slots of the respective translation plates which may be straight or of curved configuration are arranged in 90 degree relation to permit relative omnidirectional translatory positioning and movement of the translation plates for consequent selective omnidirectional therapeutic or diagnostic positioning or movement of the mandible of a patient. A translation actuator is supported by one of the translation plates and has mechanical interaction with the maxillary and mandibular translation plates and is operative to establish protrusive, retrusive and lateral movement of the mandibular plate and mouthpiece for corresponding omnidirectional protrusive, retrusive and lateral therapeutic movement of the mandible of the patient or for diagnostic positioning and movement of the mandible.

18 Claims, 5 Drawing Sheets

FIG. 13a
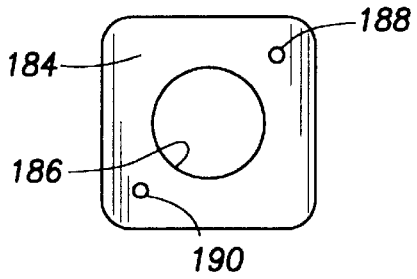
FIG. 13b
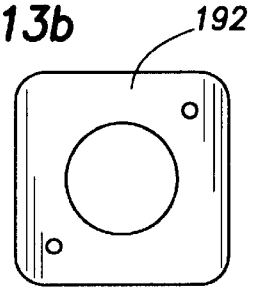
FIG. 13c
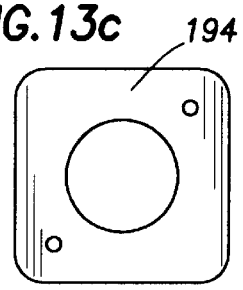
FIG. 13d
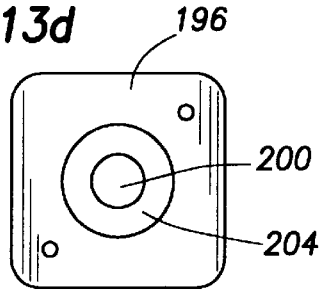
FIG. 13e
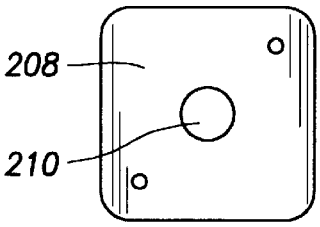
FIG. 13f
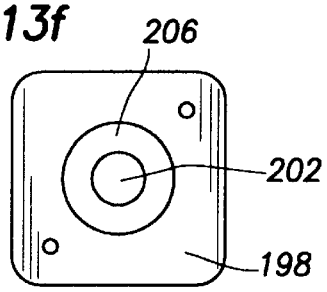
FIG. 14
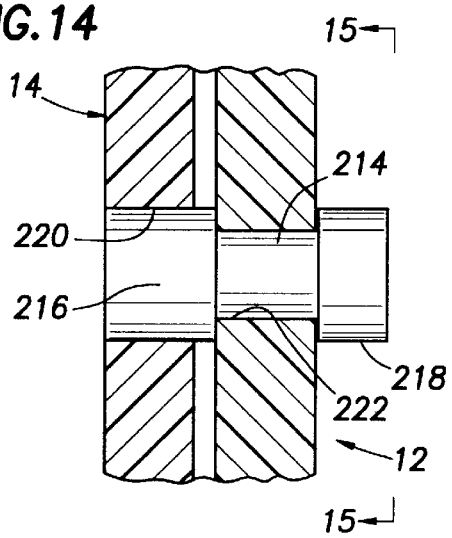
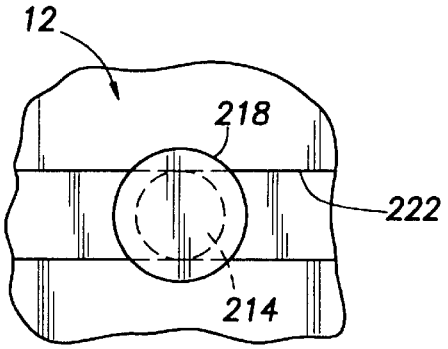
FIG. 15

PASSIVE MANDIBLE TRANSLATOR

FIELD OF THE INVENTION

This invention relates generally to apparatus for accomplishing passive mandible translation therapy such as in cases of post operative therapy following maxillofacial surgery, trauma or required therapy for the temporomandibular joint (TMJ) or therapy following prolonged mandible fixation such as in cases of surgery, fractures or other trauma to the mandible for which mandible fixation is required. More particularly, the present invention is specifically directed to a therapeutic mandible translator that may be manually operated or motorized and which is capable of accomplishing selective omnidirectional translatory motion to the mandible for therapeutic treatment the TMJ, muscular and connective tissues to promote restoration of mandible function following prolonged mandible fixation.

BACKGROUND OF THE INVENTION

As the result of maxillofacial surgery, trauma, particularly fractures of the mandible or maxillary bone structure, it is typical for the mandible to be fixed to the maxillary dentition of the patient and with the mandibular and maxillary dentition in proper occlusion during the process of complete recovery. When bone tissues have been stabilized by the healing process to the point that mandible fixation can be released, the musculoskeletal system of the patient concerning the TMJ, the musculofacial connective tissues and the various muscles will be found to be somewhat dysfunctional as the result of prolonged mandible fixation. The muscles will typically be atrophied to the point that the patient will be unable to move the mandible through its full range of motion. Additionally, the TMJ will be typically found to be somewhat dysfunctional as the result of prolonged inactivity. Typically, after mandible fixation has been released, a period of therapy is initiated to restore the mandible to its proper range of motion. Under circumstances where the therapy is designed to restore the mandible to its desired range of rotation and other motion at the TMJ various types of therapeutic apparatus is often utilized to passively control movement of the mandible, including desired characteristics of mandible motion as well as the desired range of mandible movement so as to achieve efficient therapeutic response that is well within the tolerance range of the patient from the standpoint of pain and duration. For example, the manually operated therapeutic apparatus that is set forth in Assignees U.S. Pat. Nos. 4,909,502 and 5,035,420 has been found quite effective for post-surgical therapy of this nature because the normal range of mandible motion is simulated by the apparatus during manually energized passive therapy. Additionally, it has been determined that patients can conduct therapeutic activities themselves through utilization of the apparatus shown in the above patents, thereby controlling passive motion of the mandible and being sensitive to the level of pain that typically occurs when therapy of this nature is being conducted. Further, the therapeutic activities that can be conducted by the patients themselves through use of this manually energized therapeutic apparatus thus minimizing the need for medical personnel as therapy is being conducted. This feature also permits patients to conduct therapy as often as needed and within the confines of their residences.

Being rather small and portable, as compared to typical mechanized therapeutic apparatus for this general purpose, the therapeutic apparatus shown in these patents can be carried with the patient and can easily be transported from place to place as suits the needs of the patient and medial personnel in charge of post-operative patient care.

Other apparatus that can be suitable for post-operative therapy of the TMJ and musculofacial structure of patients is represented by U.S. Pat. No. 4,883,046 of Fontenot which is of mechanized nature and which induces passive, mechanized opening and closing movement of the mandible by application of forces to the incisor dentition of the patient. Where the therapy to be conducted is in the nature of translation only, including protrusive and retrusive movement of the mandible and for accomplishing lateral or side-to-side movement of the mandible in cyclical continuous fashion, the mechanized apparatus and method set forth in U.S. Pat. Nos. 5,374,237 and 5,467,785 may be employed for conducting continuous post-surgical or post-trauma therapeutic movement of the mandible of a patient. Being apparatus for continuously cyclically moving the mandible according to preset adjustments, the apparatus set forth in these patents is incapable of selectively positioning or moving the mandible in translation for diagnostic purposes to enable medical personnel to specifically identify the character of mandible movement that is desirable for corrective or restorative therapy. It is also not possible for medical personnel or a patient using the mechanized apparatus of these patents for accomplishing non-cyclical translatory movement of the mandible. It is desirable to provide apparatus enabling medical personnel to conduct diagnostic movement of the mandible of a patient in order to more logically determine the character of therapeutic mandible movement that is desired and to also enable either medical personnel or the patient to conduct therapeutic activities of translatory positioning or movement of the mandible to achieve designed therapeutic results.

Even under circumstances where no mandible fixation has occurred, disfunction of the TMJ of a patent may have occurred by trauma, such as in the case of athletic injuries, cranio-facial surgery such as for restoration of the TMJ and for achieving proper occlusion of the dentention of a patient, etc. The apparatus that is disclosed in the above-identified U.S. Patents with the exception of U.S. Pat. Nos. 5,374,237 and 5,467,785, may be selectively employed or employed in conjunction to achieve a desired course of rotational therapeutic mandible movement activity to suit certain specific needs of the patient. Such apparatus however is not capable of being employed to achieve selective diagnostic positioning or movement of the mandible in the translatory sense or to achieve therapeutic translatory movement of the mandible of non-cyclical character when such is needed for proper restoration of the patient.

SUMMARY OF THE INVENTION

It is a principle feature of the present invention to provide novel manually operated therapeutic apparatus having the capability of being used for passive translatory movement of the mandible of a patient such as in the case of post-surgical therapy or therapy of the TMJ.

It is another feature of the present invention to provide novel therapeutic apparatus for translatory therapy of patients wherein the apparatus is provided with the capability for achieving omnidirectional translation of the mandible for therapeutic results that cannot ordinarily be obtained through the use of cyclical mechanized therapeutic translation apparatus.

It is an even further feature of the present invention to provide novel therapeutic apparatus for translatory therapy of patients which apparatus can be effectively utilized by medical personnel or by the patient for conducting therapeutic activities involving the mandible and TMJ of a patient.

It is another feature of the present invention to provide novel therapeutic apparatus for translatory therapy of patients wherein the apparatus may be employed either by medical personnel or the patient or both to identify selective positioning of the apparatus for achieving selective positioning of the mandible and "by the sensation of feel", as determined by the patient to identify therapeutic activity that is desirable for efficient restoration of the normal range of mandibular motion for the patient.

Other and further features of the present invention will become obvious to those experienced in the art to which the invention pertains upon an understanding of the preferred embodiment of the invention as set forth herein.

Briefly, the various features and principles of the present invention are realized through the provision of a mandible translation mechanism having the capability for achieving omnidirectional translatory positioning or movement of the mandible of a patient for achieving therapeutic activities as desired for restoring the full range of mandible motion that is anatomically possible. The mandible translation mechanism of the present invention may be manufactured for manual operation by medical personnel or for self use by the patient and may also be manufactured for mechanized operation in the event such is found desirable.

In its simplest form apparatus embodying the principles of the present invention, and being adapted for manual operation, employs maxillary and mandibular elements in the form of generally rectangular translator plates each defining a plurality of elongate guide slots. The guide slots of the maxillary translator element are oriented in right angular relation with the elongate guide slots of the mandibular translator plate element. Additionally, the maxillary translator plate element is provided with a handle which enables the apparatus to be supported by medical personnel or by the patient. Interposed between the maxillary and mandibular translation plates is a translation control element, also in the form of a generally rectangular plate. The translation control plate is provided with a plurality of translation guide projections in the form of turret posts or guide pins that project from opposed faces of the translation control plate and establish respective guiding relation within the elongate guide slots of the maxillary and mandibular translation plates. This arrangement effectively permits relative protrusive, retrusive and lateral positioning of the maxillary and mandibular translator plates within a range of movement that somewhat exceeds the normal range of movement of the mandible of most patients.

For relative diagnostic positioning of the translator plates and for conducting manually controlled therapeutic translatory movement of the mandible of the patient under the control of either medical personnel or the patient, the apparatus is provided with an actuator mechanism that permits selective omnidirectional translatory movement or positioning of the translator plates relative to the translation control plate and relative to one another. An actuator body is fixed in any suitable manner to the mandibular translation plate and defines an internal cavity within which is positioned a spherical actuator component being located intermediate the ends of an elongate actuator lever. The actuator body is internally configured so that the internal cavity secures the spherical actuator component for rotational movement and permits the elongate actuator lever to have a desired range of rotational movement about the pivot point of the spherical actuator component. One end of the actuator lever is located within a fairly close fitting aperture in the maxillary translation plate so that it is essentially pivotally related to the maxillary translation plate. The opposite end of the elongate actuator lever is exposed for manual movement by medical personnel or by the patient. This arrangement allows for selective omnidirectional translatory positioning or movement the translation plates relative to one another. Each of the translation plates incorporate fixation means in the form of a mouth piece which is designed to receive a "rope" of light cure acrylic dental impression material or other suitable impression which is cured after it has been deformed by a patients dentition. The teeth of the patient, typically the incisor teeth, are received by the impression of the cured impression material to temporarily fix the maxillary arch of the patient to the maxillary translation plate and to temporarily fix the mandibular arch of the patient to the mandibular translation plate. Thus, when the translation plates are moved relative to one another by the actuator mechanism in response to controlled movement of the actuator lever, the mandible of the patient will be passively moved along with the mandibular translation plate.

In the event mechanized operation of the translation mechanism is desirable the actuator mechanism may be provided with a suitable motor, typically electrically powered by a battery source or powered by the low voltage dc electrical current of a conventional transformer. The actuator motor will accomplish movement of the actuator lever for achieving consequent relative movement of the translation plates.

BRIEF DESCRIPTION OF THE DRAWINGS

IN THE DRAWINGS

Figure 1:
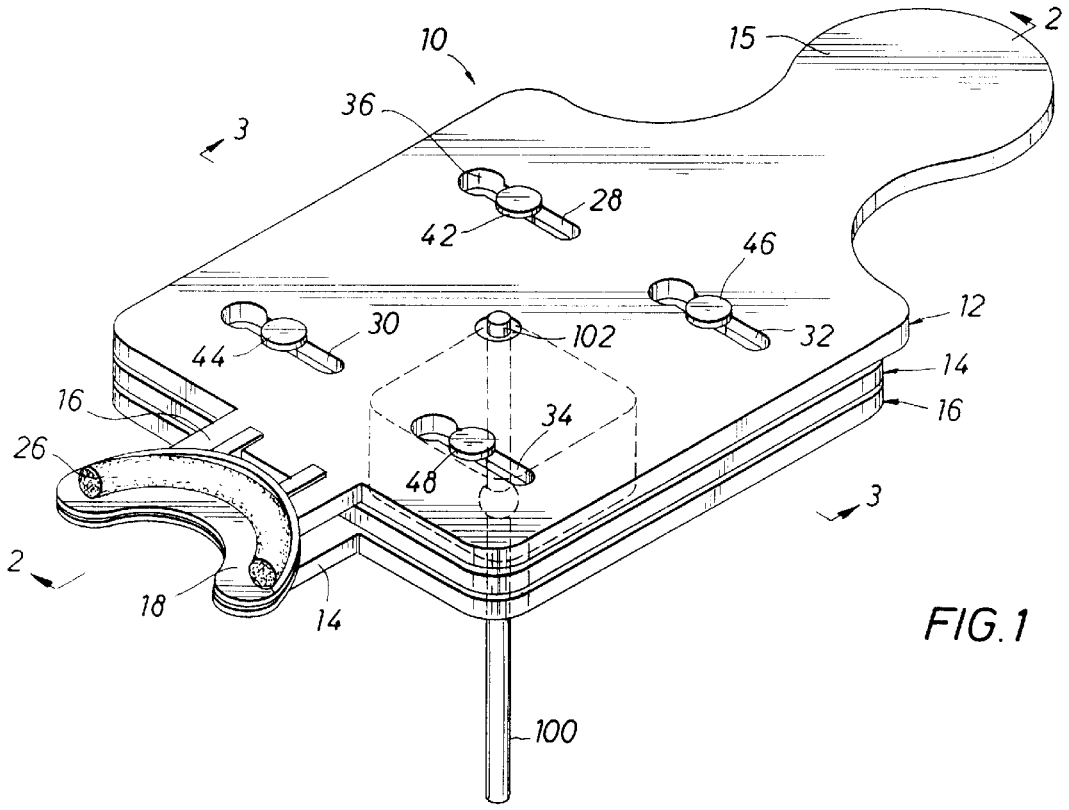

FIG. 1 is a isometric illustration of a mandible translation mechanism that is constructed in accordance with the present invention and is shown with the components thereof in the neutral position as would occur when the patient's dentention is in proper occlusion.

Figure 2:
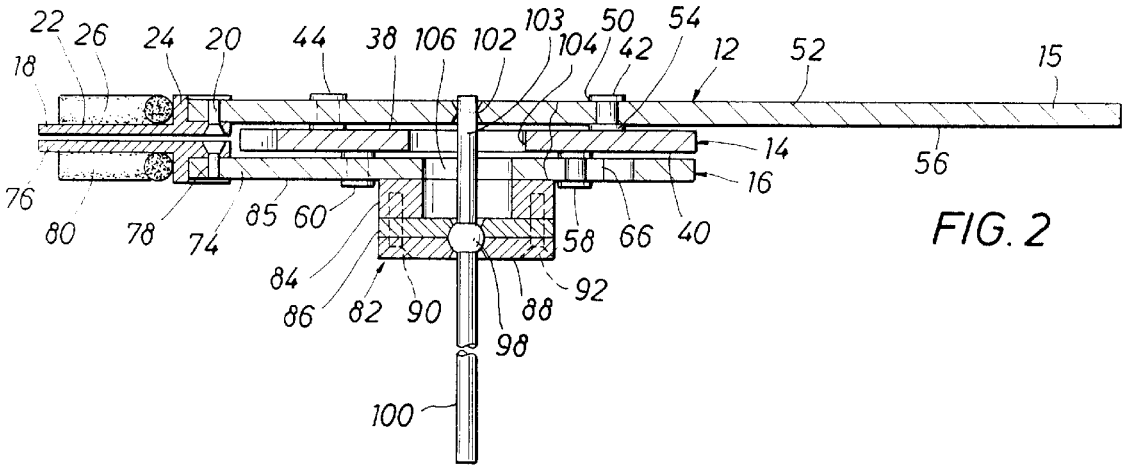

FIG. 2 is a sectional view of the mandible translator mechanism taken along line 2—2 of FIG. 1.

Figure 3:
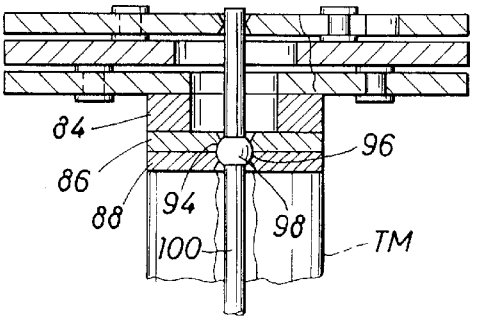

FIG. 3 is a sectional view of the mandible translator mechanism taken along line 3—3 of FIG. 1.

Figure 4:
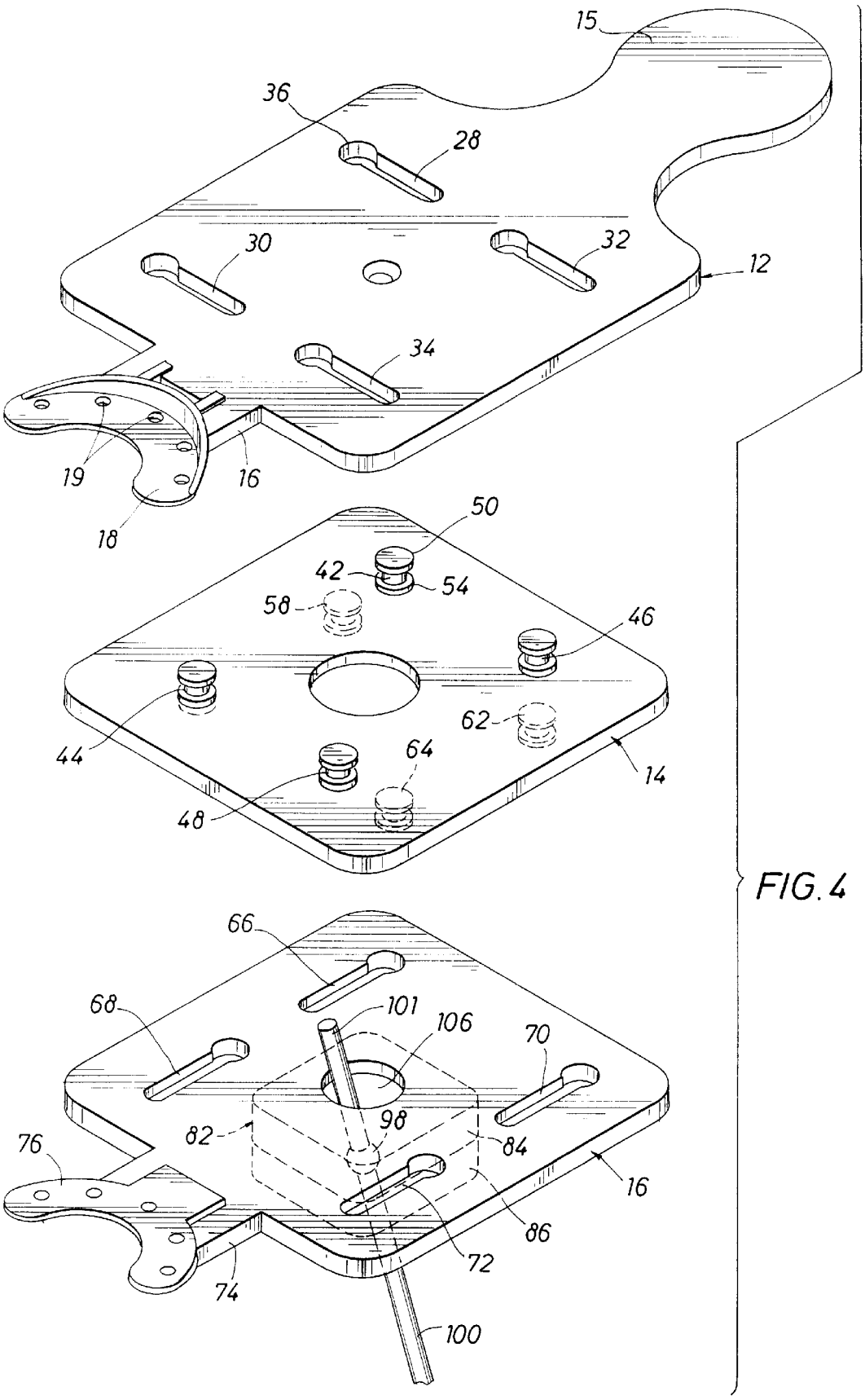

FIG. 4 is a exploded isometric illustration of the mandible translator mechanism of FIGS. 1–3.

Figure 5:
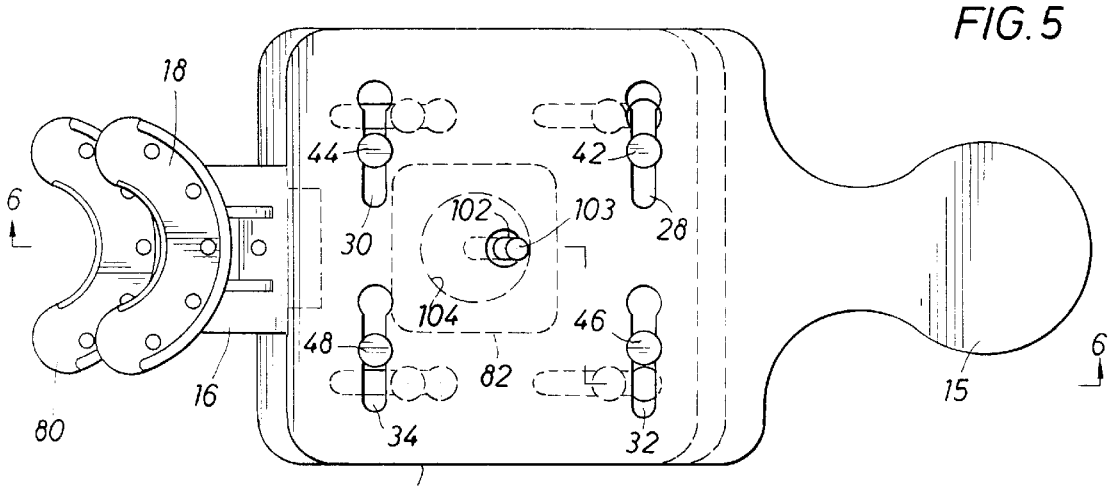

FIG. 5 is a plan view of the mandible translator mechanism of FIGS. 1–4 with the mandibular element and its mandible fixation element shifted to a retrusive position.

Figure 6:
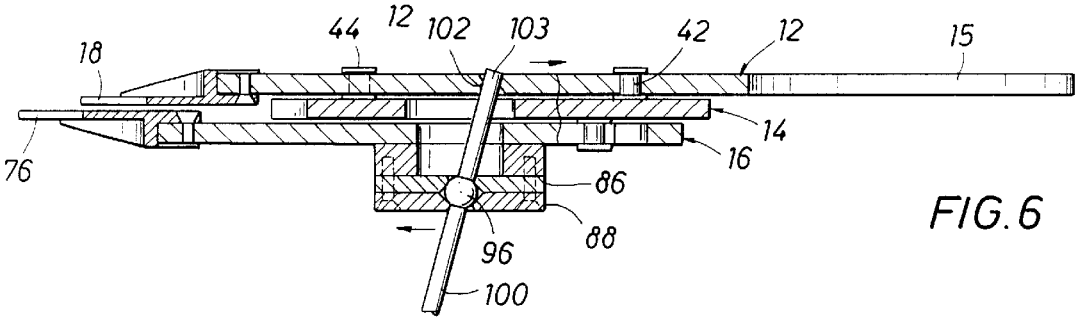

FIG. 6 is a sectional view taken along line 6—6 of FIG. 5 and showing the physical relationships of the maxillary translation element, the mandibular translation element, the translation control element and the translation actuator for accomplishment of the physical relationship shown in FIGS. 5 and 6.

Figure 7:
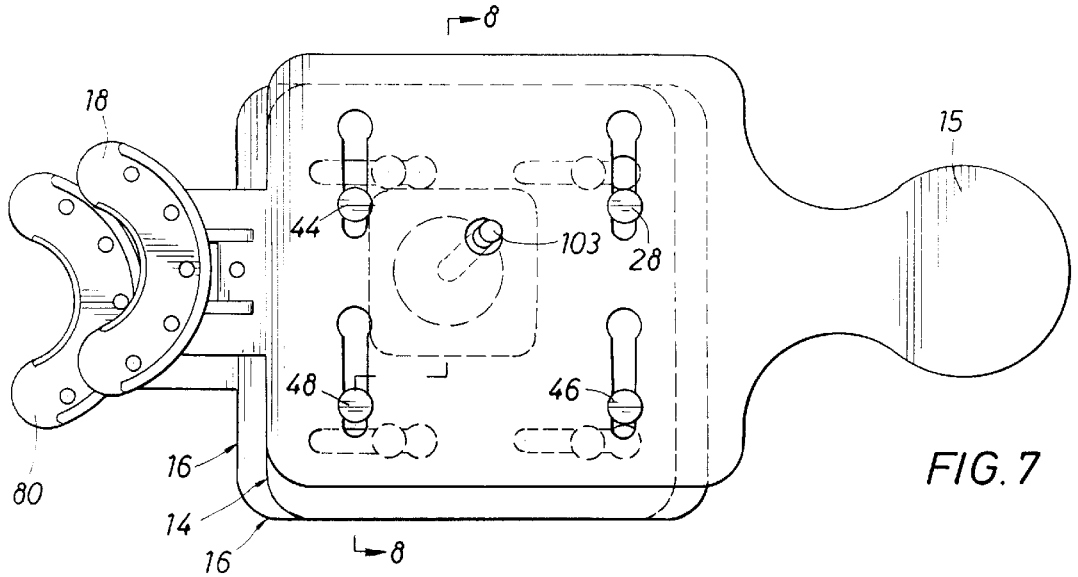

FIG. 7 is plan view similar to that of FIG. 5 and showing the mandibular translation plate element and its mandibular fixation element positioned both retrusively and laterally or sideways, as compared to the positional relationships shown in FIGS. 5 and 6.

Figure 8:
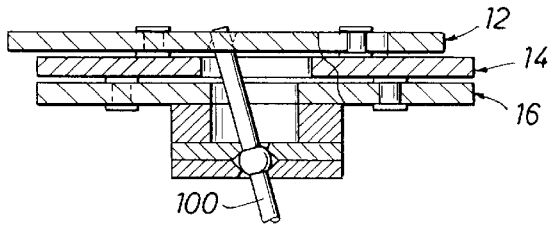

FIG. 8 is a partial sectional view taken along line 8—8 of FIG. 7 and showing the position of the translation actuator mechanism for accomplishing the relative positions of the translation plate components that is shown in FIG. 7.

Figure 9:
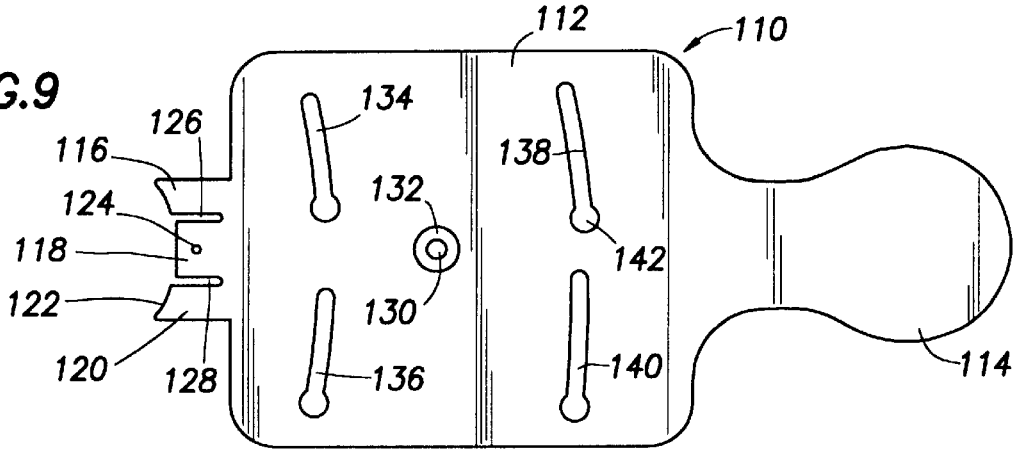

FIG. 9 is a plan view of the maxillary translation plate of an alternative embodiment of the present invention which is designed to achieve characteristics of normal TMJ movement.

Figure 10:
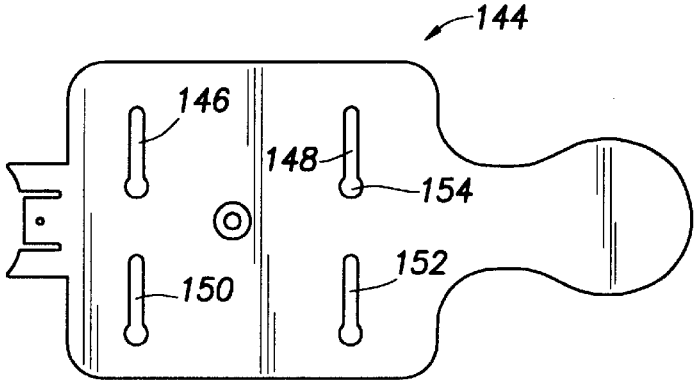

FIG. 10 is a plan view of the maxillary translation plate of another alternative embodiment of this invention having a forward projection designed to receive a mouthpiece element and having straight, parallel guide slots.

Figure 11:
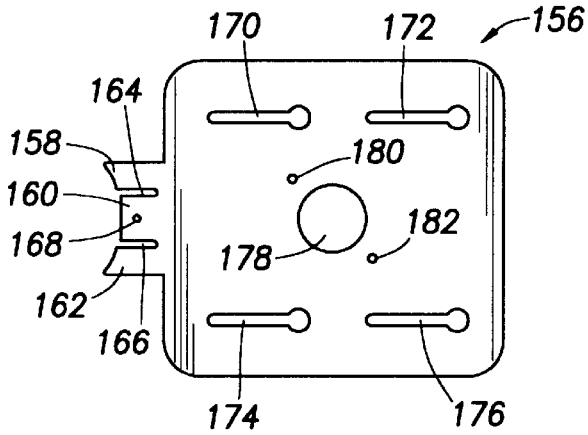

FIG. 11 is a plan view of the mandibular translation plate of the embodiment shown in FIG. 10.

Figure 12:
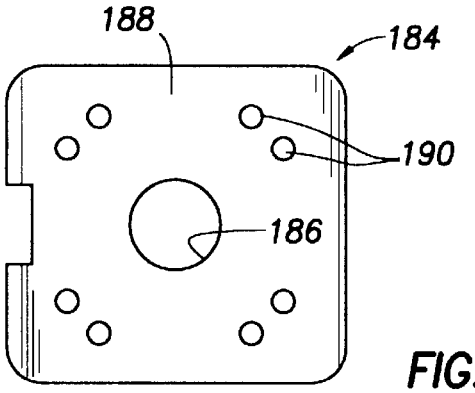

FIG. 12 is a plan view of the translation guide plate of the embodiment employing the plate structures of FIGS. 10 and 11.

FIGS. 13*a*–13*f* are plan views of the various actuator body plates that are assembled to define the actuator housing structure of the embodiment of FIGS. 10–12.

FIG. 14 is a fragmentary sectional view showing a portion of the guide plate and a translation plate and by way of full line showing one of the turret posts that establish spacing and guiding relation between the guide plate and translation plate and further showing the manner by which the turret post is secured to the guide plate.

FIG. 15 is a fragmentary plan view taken along line 15—15 of FIG. 14.

DETAILED DESCRIPTION OF PREFERRED EMBODIMENT

Referring now to the drawings and first to FIGS. 1–4, a translator apparatus for achieving omnidirectional translation of mandible of a human patient is shown generally at 10 and incorporates 3 basic translation elements shown generally at 12, 14 and 16 that are moveably interconnected and cooperatively provide for omnidirectional translation controlling movement of the mandible of a human patient undergoing passive mandible translation therapy such as for cranial muscular therapy or therapy of the temporal mandibular joint (TMJ) for any number of therapeutic activities that may be designed for the patient.

The translator element 12 is a maxillary element which conveniently take the form of a substantially flat and generally rectangular plate as shown, but which may take any other convenient form that is appropriate to provide therapeutic advantage to the patient and to those in charge of the patient. The maxillary translation element 12 may define a handle structure 15 that may be grasped by those conducting therapy for the patient or by the patient, under circumstance where the patient is conducting self-therapy. At the forward end, the end of the maxillary translation plate, opposite the handle 15, the maxillary translation plate element 12 defines a support projection 13 to which is connected a maxillary mouthpiece element 18 such as by means of one or more connecting screws 20. The mouthpiece element 18 defines a generally planer upwardly facing surface 22 and an upstanding curved rib 24 that tapers at each extremity to the planer surface 22. The curved rib 24 serves a locator surface for location of a "rope" 26 of light cure type acrylic dental impression material such as is marketed under the trademark "Triad" by Dentsply International, Inc. Though supplied in the form of a rope having a circular cross-sectional configuration as shown in FIG. 1, the dental impression material is easily formed by pressing on it with the fingers so that it can cover a majority of the upwardly facing surface 22 of mouthpiece 18. The dental impression material is also formed by the maxillary dentention of the patient as the patient bites down on it with the patient's maxillary and mandibular dentention in proper occlusion. If desired, the mouthpiece structure 18 maybe provided with depressions or holes therein the permit the dental impression material to more adequately adhere to the mouthpiece. After being properly formed and after the patient has bitten down on the rope of acrylic material to form teeth impressions, the acrylic material is subjected to ultraviolet light which causes it to rapidly cure to a rubber like body having the impression of the patient's dentention therein.

The maxillary element 12 is provided with a plurality of laterly oriented elongate slots such as shown at 28, 30, 32 and 34 each being oriented in substantially normal relation with the center line 2—2 of the sectional view of FIG. 2. Each of these transverse slots defines an enlarged, generally circular slot end one of which being shown at 36.

The translation element 14 is a translation control element which may also be in the form of a substantially flat plate as is evident from FIGS. 2 and 3 and which also may be of substantially rectangular configuration as shown. The translation and control element is shown to define upper and lower substantially planar surfaces 38 and 40. A plurality of upwardly projecting lateral translation control posts or pins 42, 44, 46 and 48 project upwardly from the translation control plate element and extend through respective lateral translation slots 28–34 and establish lateral guiding relationship that permits relative lateral movement of the maxillary translation element and the translation control element. The lateral translation guide posts 42–48 translet in are fixed to the translation control element 14 in any suitable manner such as by threading, bonding, integral assembly, etc. and are each provided with heads, one of which being shown at 50 in FIG. 2 which overlie the upwardly facing surface 52 of the maxillary translation element at the respective transverse translation slots 28–34. The detailed construction of the translation guide posts and their relation with the control plate is shown in FIGS. 14 and 15. The heads of the posts thus prevent separation of the maxillary translation element from the translation control element 14. The translation guide posts may also be provided with spacer flanges such as shown at 54 in FIGS. 2 and 4 which are contacted by the lower planar surface 56 of the maxillary translation element 14 and which space the lower planer surface 56 of the maxillary translation element from the upwardly facing planar surface 38 of the translation control element 14. This structural relationship is clearly evident in FIGS. 2 and 3.

The translation control or guide element 14 is also provided with a plurali ty of downwardly projecting translation guide posts 58, 60, 62 and 64, also referred as turret posts, that may be identical in construction with the lateral translation control pins 42–48 and which project through respective longitudinal guide slots 66, 68, 70 and 72 that are defined in the mandibular translation element 16. The mandibular translation element may also be in the form of a substantially flat, generally rectangular plate as shown particularly in FIGS. 1 and 4 and, in addition to the longitudinal translation slots, may be provided a fixation projection 74 which may be of substantially the same configuration as the projection 16 of the maxillary translation element 12. A mandibular fixation mouthpiece 76, which may be substantially identical with the maxillary fixation mouthpiece 18, may be fixed to the projection 74 by means of a plurality of connector screws 78 as shown in FIG. 2. The mouthpiece 76 may also be provided with a rope 80 of light cure dental impression material which will be used to provide an impression of the mandibular detention of the patient. To provide for maxillary and mandibular fixation of the translation elements 12 and 16 to the respective maxillary and mandibular dentition of the patient, the translation elements 12, 14 and 16 will be placed in the neutral position as shown in FIGS. 1 and 2 with the mouthpiece elements 18 and 76 in registering relation. The patient will then bite on both of the ropes 26 and 80 of dental impression material thereby forming impressions of the maxillary and mandibular detention. After having light cured the impression material, it will serve as a manner by which the dentention of the patient can be fixed to the translation elements 12 and 16. As these translation elements are then moved laterally, longitudinally or both laterally and longitudinally with respect to one another, the mandible of the patient is caused to translate along with the mandibular translation element 16. The respective lateral and longitudinal translation guide slots are of sufficient length to permit mandible translation movement to the maximum extent that is desired. The range of lateral and longitudinal translation of the apparatus is evident from FIGS. 5–8. Translation of the mandible of a patient is intended to be passive through use of the apparatus 10, whether the apparatus is manually operated as shown in FIGS. 1 and 2 or power operated as shown in FIG. 3.

Various translation apparatus, such as is evidenced by U.S. Pat. Nos. 4,883,046 of Fontenot and 5,467,785 and 5,374,237 of McCarty, Jr., is intended to manipulate the mandible of a patient passively and continuously so as to achieve therapeutic activity, typically therapeutic movement of the TMJ. Though continuous mechanized movement of the mandible of a patient may have beneficial therapeutic aspects it has been determined that therapeutic mandible translation apparatus can be quite effective if it provides the user, either medical personnel or the patient to passively and controllably induce movement of the mandible in a manner that accomplishing desired results. In the case of the patient, it is desirable that the patient have the capability of accomplishing passive translation of the mandible in a manner that is not continuous but rather is selective. This will permit the patient to manipulate the mandible by "feel" so as to accomplish the therapeutic result that is desired by the physician or surgeon in charge of the patient. For example, the mandible may be moved laterally, retrusively or protrusively or a combination of such movements on a selective basis to enable the patient to "feel" when appropriate therapy is being accomplished. When mechanized translation equipment is employed that achieves continuous or mechanized actuation of the mandible and especially when the therapy is being conducted by someone other than the patient, the translation movement that is occurring may not be therapeutically effective and in fact, may be therapeutically detrimental. When selective therapeutic mandible translation is being accomplished, those components of lateral, protrusive and retrusive translation movement that occur can be selective so that optimum TMJ or musculoskeletal translation can be effected according to the specific therapeutic needs of the patient.

For accomplishing translatory movement of the mandible with lateral, protrusive and retrusive components of movement as selected by a patient or medical personnel in charge of the patient or accomplished in motorized fashion, the present invention employs a translation actuation mechanism shown generally at 82. The translation actuator incorporates an actuator body 84 that is fixed in any suitable manner to the lower planer surface 85 of the mandibular translation element 16. The translator body may be bonded to element 16 or, in the alternative, may be formed integrally with the translation element 16 is desired. The actuator body is provided with a pair of support plates 86 and 88 that are secured in assembly with one another and in assembly with the actuator body 84 by means of plurality of retainer screws 90 and 92 as shown in broken line in FIG. 2. The support or mounting plates 86 and 88 are formed centrally thereof to define tapered or spherical receptacle sections 94 and 96 respectively that function cooperatively to retain and provide rotational support for a spherical actuator component 98 of an elongate actuator lever element 100. That portion of the elongate actuator lever element that is located below the spherical actuator component 98 is intended for manipulation by a patient or by medical personnel or by a motorized mechanism shown at TM in FIG. 3. That portion of the actuator lever element that is located above the spherical actuator component 98 is intended as a drive section that extends through a centrally located aperture 102 of the maxillary translation element 12. The aperture 102 defined by a central restriction of a diameter for close fitting relation with the upper drive end of the actuator lever element 100 and by tapered upward and downward facing tapered surfaces such as shown in FIGS. 1, 2, and 3. The central aperture configuration permits the upper drive end of the translation actuator 100 to be positioned in angular relation with the mandibular translation plate such as is shown by FIGS. 5–8. The spherical actuator component 98 functions essentially as a pivot to permit omnidirectional positioning of the actuator lever element about the enter point of the spherical actuator component 98 and that omnidirectional therapeutic translation of the mandibular translation element may relative to the maxillary translation element be efficiently accomplished. To permit the desired range of actuator lever movement about its spherical actuator component the translation control element 14 defines a large central opening 104 and both the mandibular translation element 16 and the actuator body 84 cooperatively define a central opening or passage 106. Thus, as the actuator element 100 is actuated about its spherical actuator component 98 in any angular relationship, whether lateral, protrusive or retrusive, the upper drive end of the actuator lever element will not come into contact either with the translation control element or the structure of the translation actuator assembly 82. The central aperture 102 of maxillary translation element 12 will function essentially as a pivot or reaction point during all manner of translation movement. Concurrently, the spherical actuator component 98 of the lever will rotate relative to the actuator retainer plates 86 and 88 to thereby permit translation movement of the mandibular translation element relative to the maxillary translation element. As these events happen, the translation control element 14 will control the manner by which elements 12 and 16 are permitted to move relative to one another.

OPERATION

An operational sequence is typically begun with the respective translation elements 12, 14 and 16 in the neutral positions relative to one another as shown in FIG. 1. Prior to translation movement however the dental impression rope material 26 and 80 will have been deformed to provide maxillary and mandibular impressions of the patients detention, with the impressions being the manner by which the patient's dentention is temporarily fixated with respect to the translation elements 12 and 16. The patient will insert the respective dentention into the impressions so that movement of the apparatus will apply a force to the respective maxillary or mandibular dentention. Typically, when the apparatus is of manual character or when it is utilized manually, the maxillary translation element 12 will remain substantially static with respect to the head and maxillary dentention of the patient. The user, either therapy personnel or the patient will grasp the handle 15 of the maxillary translation element 12 so as to further stabilize it with respect to the cranial anatomy of the patient. For retrusive movement of the mandible such as is shown in FIG. 5, without lateral translation of the mandible the actuator lever element 100 will be moved forwardly causing the upper drive extremity 103 thereof to essentially accomplish pivotal movement within the restricted central aperture 102. When the actuator lever element 100 is pivoted in this manner, the spherical component 98 will apply a force to the interconnected retainer plates 86 and 88 in the direction of the force arrow, thereby causing movement of the mandibular translator plate element 16 to the retrusive position shown in FIG. 6, thereby driving the mandible rearwardly or retrusively. As this retrusive movement occurs, the guide posts 42–48 will remain substantially centralized with respect to the elongate lateral guide slots 28–34. As shown in broken line in FIG. 5 however and as shown in full line in FIG. 6, the downwardly projecting translation guide posts will be shifted toward the maximum extent of their travel within the elongate guide slots of the mandibular translation element 16.

When lateral movement of the mandibular translation plate is desired, or perhaps both lateral movement and either protrusive or retrusive movement, the lower end of the elongate actuator lever element is simply moved laterally to cause its rotation about the spherical actuator component. When this is done the upper end of the actuator lever is pivoted sidewise within the central actuator aperture of the maxillary translation plate, thus causing the spherical actuator component to apply sidewise force to the actuator housing and thus to the mandibular translation plate and, through the mouthpiece, to the mandible of the patient. It is thus evident that, by manipulating the actuator lever forwardly, rearwardly or laterally or a combination of these movements, the mandible of the patient will be moved protrusively, retrusively, laterally or a combination thereof Thus the mandible may be moved omnidirectionally and selectively as is desired for therapeutic diagnostics or as is desired for therapeutic mandible movement by the patient or by personnel accomplishing patient therapy.

Referring now to FIGS. 9–15, alternative embodiments of the present invention are shown. As shown particularly in FIG. 9, a maxillary translation plate, shown generally at 110, defines a generally rectangular plate body 112 having an integral handle 114 and having a plurality of forward projections 116, 118 and 120 that collectively define an arch 122 of a configuration for receiving a mouthpiece element similar to that shown in FIGS. 1–8. The intermediate projection 118 is of generally rectangular configuration and defines an aperture 124 to receive a bolt, screw or other mouthpiece connective element. The forward projections are spaced in such manner as to define parallel slots 126 and 128 on opposed sides of the central projection 118. These parallel slots are locator slots which receive corresponding parallel locator ribs that are present on the mouthpiece element. The plate body structure 112 also defines a small pivot aperture 130 which is surrounded by at least one tapered surface 132 thus defining a thin cross sectional configuration about the pivot aperture 130 which establishes an essentially pivotal relation with the elongate actuator shaft of the translation apparatus. The actuator shaft, spherical actuator component, the intermediate translation guide plate and lower mandibular translation plate will be of essentially of the same configuration as shown above in connection with FIGS. 1–8. It is well known that the normal lateral motion of the mandible is not true translation but is actually a rotation about an apparent vertical axis located midway between the TMJs and somewhat to the rear of them. It is thus desirable provide translation apparatus having the capability of moving the lower translation plate and thus the mouthpiece and mandible of the patient about this apparent vertical axis during lateral translation movement. To accomplish this feature, the rectangular body portion 112 also defines a plurality of elongate, generally curved guide slots 134, 136, 138 and 140 each having respective slot enlargements at the ends thereof such as shown at 142. The curvature of the curved guide slots is such that the lower translation plate will be moved in a manner corresponding to the anatomical characteristics of the human TMJ. This feature relieves any unnatural twisting of the mandible at the TMJs that would result by the provision of simple orthogonal motion of the mandibular translation plate. The guide projections or posts of the intermediate translation guide plate have enlarged head portions that are received within the slot enlargements 142 to thereby enable easy assembly of the translation plates and the guide plate. This feature also enables the plates to be easily disassembled without any necessity of the use of tools, such as for cleaning or for any other suitable purpose. The curved guide slots provide the translation apparatus with a slightly differing degree of omnidirectional motion capability as compared to the straight guide slots of the embodiment shown in FIGS. 1–8.

FIG. 10 shows the maxillary translation plate element of an alternative embodiment illustrated generally at 144 which is of the same general configuration as shown in FIG. 9 with the exception that guide slots 146, 148, 150 and 152 are of straight configuration again having enlarged generally circular end portions such as shown at 154.

Referring now to FIG. 11 the mandibular translation plate of the embodiment of FIG. 10, being shown generally at 156, defines three spaced forward projections 158, 160 and 162 that are also spaced in the manner described above in connection with FIGS. 9 and 10 to define generally parallel mouthpiece rib locator slots 164 and 166. The intermediate, generally rectangular projection 160 defines an aperture 168 to permit connection of a mandibular mouthpiece in fixed relation with the plate 156. It should be noted that the elongate, generally straight guide slots 170, 172, 174 and 176 are oriented in substantially 90 degrees relation with respect to the guide slots shown in FIG. 10. By correlating the positions of the respective guide posts of the intermediate translation plate shown in FIG. 12 with the guide slots of the plates shown in FIGS. 10 and 11, various aspects of protrusive, retrusive and lateral translatory positioning may be achieved by the respective translation plates. Centrally of the generally rectangular mandibular translation plate 156 is defined a relatively large aperture 178 that permits the elongate actuator lever to have omnidirectional freedom of movement within limits defined by the size of the central opening. The central opening 178 is sufficiently large to permit the relative movement of the translation plates and guide plate that is necessary for the full range of relative translation movement that is desired. Additionally, the mandibular translation plate is provided with a pair of small apertures 180 and 182 to enable an actuator body to be retained in assembly therewith by means of screws, bolts or other suitable retainer devices. The intermediate guide plate, shown generally at 184 in FIG. 12, also defines a large central opening 186 which permits the actuator lever to have sufficient freedom of pivotal position about the spherical actuator component to achieve the degree of translation movement that is desired by the apparatus. On opposed sides of the generally rectangular guide plate 188, guide projections such as shown at 190 extend for guiding relation with the respective guide slots of the translation plates.

FIGS. 13*a*–13*f* are representive of the relative construction of multiple generally rectangular actuator housing plates that cooperatively make up the actuator housing of the translation mechanism. The generally rectangular plate 184 shown in FIG. 13*a* is adapted to be fixed directly to the mandibular translation plate 184 shown in FIG. 12. This plate may be composed of acrylic material which is solvent bonded or otherwise bonded directly to the central portion of the mandibular translation plate. The plate will define a central opening 186 to permit freedom of actuator lever movement and may be provided with apertures 188 and 190 to permit connection of the actuator body plate to the mandibular translation element by means of screws or bolts. The actuator housing is defined by additional actuator plates such as shown at 192 in FIG. 13*b* and 194 in FIG. 13*c*. These actuator body plates may be of identical construction as compared with body plate 184 so as to collectively define an actuator body structure. Actuator body plates 196 and 198 of FIGS. 13*d* and 13*f* fare connected in stacked relation with body plate 194 and defined central openings 200 and 202 respectively that receive the elongate actuator lever or shaft therethrough. These apertures are surrounded by tapered or spherical surface segments as shown at 204 and 206 respectively. FIG. 13*e* shows a generally rectangular actuator plate 208 that may be substituted for the actuator plate 198 as desired. The plate 208 defines a central aperture 210 for receiving the elongate actuator lever, but this aperture is not surrounded by a tapered or spherical surface segment as is shown at 206 in FIG. 13*f*.

FIGS. 14 and 15 are enlarged figures showing the turret post design that is employed for insuring separation of the translation plates from the guide plate such as is shown in the sectional view of FIG. 6. As shown in FIG. 14, the turret post shown generally at 212 defines a generally cylindrical intermediate post section 214 having cylindrical end sections 216 and 218 as shown which are of greater dimension as compared with the intermediate post section 214. The cylindrical post extremities 216 and 218 are of the same circular dimension by cylindrical end section 216 is of greater length as compared to cylindrical end section 218. The large end section 216 may be defined as the base end section because it is adapted to be received in close fitting, perhaps press-fitted relation within a respective aperture such as shown 220 in translation guide plate 14. Thus, when the translation plate 12 is received in assembly with the guide plate, the turret post, serving as a guide projection will be received within the guide slot 222 of a translation plate such as shown at 12 in FIG. 14. A circular shoulder. The enlarged end section 218 of the turret post will function as a retainer head to prevent inadvertent separation of the translation plate from the guide plate.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A translator apparatus for achieving omnidirectional translation of the mandible of a human patient, comprising:

(a) a maxillary translation element having a maxillary fixation element thereon for establishing a substantially fixed relation of the maxillary dentition of the patient and said maxillary translation element;

(b) a mandibular translation element having a mandibular fixation element thereon for establishing substantially fixed relation of the mandibular dentition of the patient and said mandibular translation element;

(c) a translation control element being interposed between said maxillary translation element and said mandibular translation element and having means for providing linear translation with said maxillary element along a first direction and having means for providing linear translation with said mandibular element along a second direction; and (d) a translation actuator having mechanical interaction with said maxillary element, said mandibular element and said control and being operative to establish relative protrusive, retrusive and lateral movement of said maxillary and mandibular elements for corresponding omnidirectional protrusive, retrusive and lateral translation movement of the mandible of the patient by effecting relative linear movements between said maxillary element, said mandibular element and said translation control element.

2. The translator apparatus of claim 1, wherein:

(a) said maxillary translation element defining at least one first linear guide:

(b) said mandibular translation element defining at least one second linear guide; and (c) said translation control element having first and second guide engaging means thereon being disposed for respective guided engagement with said first and second linear guides.

3. The translator apparatus of claim 2, wherein:

(a) said at least one first linear guide being at least one first elongate guide track being oriented for movement of said mandibular element between protrusive and retrusive positions relative to a neutral position where the dentition of the patient is in occlusion; and (b) said at least one second linear guide being at least one second elongate guide track being oriented in substantially normal relation with said at least one elongate first guide track.

4. The translator apparatus of claim 3, wherein:

said first and second elongate guide tracks having sufficient length for controlling protrusive, retrusive and lateral movement of said maxillary and mandibular elements to permit post-operative restorative therapy of the musculoskeletal anatomy of the mandible, and temporomandibular joint of the patient.

5. The translator apparatus of claim 2, wherein:

(a) said translation control means being interposed between said maxillary and mandibular translation elements; and (b) said guide engaging means being first guide engaging posts extending from said translation control element into interengaging guiding relation with said maxillary translation element and second guide engaging posts extending from said translation control element into interengaging guiding relation with said mandibular translation element.

6. The translator apparatus of claim 1, wherein:

(a) said maxillary fixation element includes a maxillary mouthpiece tray for receiving a dental impression material capable of being formed to the maxillary dentition of the patient;

(b) said mandibular fixation element includes a mandibular mouthpiece tray for receiving a dental impression material capable of being formed to the mandibular dentition of the patient; and (c) said translation control element being of plate-like configuration and being disposed in spaced relation with said maxillary and mandibular translation elements.

7. The translator apparatus of claim 1, wherein:

said translation actuator having pivotal relation with said maxillary translation element and omnidirectional translatory driving relation with said mandibular translation element for accomplishing protrusive, retrusive and lateral movement of said mandibular translation plate relative to said maxillary translation element.

8. The translator apparatus of claim 1, wherein:

(a) actuator housing means being disposed in immovable relation with said mandibular translation element and defining an internal actuator receptacle; and (b) said translation actuator includes an elongate actuator lever extending through said internal actuator receptacle and having a first end portion thereof in substantially pivotal relation with said maxillary translation element and an intermediate portion thereof in omnidirectional pivotal relation with said actuator housing means, said elongate actuator lever having a second end portion thereof adapted for translation controlling movement thereof.

9. The translator apparatus of claim 8, wherein:

(a) said elongate actuator lever having a spherical actuator component intermediate said first and second ends; and (b) said actuator housing defining internal support surfaces mounting said spherical actuator component for omnidirectional rotational motion within said actuator housing.

10. The translator apparatus of claim 9, wherein:

(a) said maxillary translation element defining an actuator opening; and (b) said first end of said elongate actuator lever being located within said actuator opening and having a range of omnidirectional angular positioning relative to said maxillary translation element.

11. The translator apparatus of claim 1, wherein:

said translation actuator having a motorized means for accomplishing mechanized translatory movement of said mandibular maxillary translation element for passive translation of the mandible of the patient.

12. The translator apparatus of claim 1, wherein:

(a) said maxillary and mandibular translation elements each being of substantially plate-like flat configuration;

(b) wherein said maxillary translation element defines a plurality of elongate lateral guide slots being oriented for lateral movement of said maxillary translation element relative to said translation control element;

(c) wherein said mandibular translation element defines a plurality of elongate guide slots being oriented for protrusive and retrusive movement of said mandibular translation element relative to said translation control element; and (d) said translation control element having a plurality of guide posts projecting form opposed sides thereof and having guiding engagement within respective guide slots of respective maxillary and mandibular translation elements.

13. The translator apparatus of claim 12, wherein:

(a) said elongate guide slots of said maxillary translation plate being of curved configuration.

14. The translator apparatus of claim 12, wherein:

(a) said elongate guide slots of said mandibular and maxillary translation plates having enlarged slot ends; and (b) said guide posts having retainer heads thereon of a dimension greater than the width of said elongate guide slots and being sufficiently small to pass through said enlarged slot ends.

15. A translator apparatus for achieving omnidirectional translation of the mandible of a human patient, comprising:

(a) a maxillary translation plate defining a longitudinal axis and having a maxillary mouthpiece element thereon for establishing a substantially fixed relation of the maxillary dentition of the patient and said maxillary translation element said maxillary translation plate defining at least one elongate guide slot being oriented in transverse relation with said longitudinal axis;

(b) a mandibular translation plate having a mandibular mouthpiece element thereon for establishing substantially fixed relation of the mandibular dentition of the patient and said mandibular translation element, said mandibulary translation plate defining at least one elongate guide slot being oriented in substantially perpendicular relation with said elongate guide slot of said maxillary translation plate;

(c) a translation control plate being interposed between said maxillary translation plate and said mandibular translation plate and having linearly moveable relation with said maxillary element along a first direction and having linearly moveable relation with said mandibular element along a second direction;

(d) guide post means projecting from opposed sides of said translation control plate and having guiding engagement within respective guide slots of side maxillary and mandibular translation plates (e) a translation actuator having mechanical interaction with said maxillary element and said mandibular element and being operative to establish relative protrusive, retrusive and lateral movement of said maxillary and mandibular plate for corresponding omnidirectional protrusive, retrusive and lateral translation movement of the mandible of the patient.

16. The translator apparatus of claim 15, wherein:

said translation actuator having pivotal relation with said maxillary translation element and omnidirectional translatory driving relation with said mandibular translation element for accomplishing protrusive, retrusive and lateral movement of said mandibular translation plate relative to said maxillary translation element.

17. The translator apparatus of claim 15, wherein said translation actuator comprising:

(a) actuator housing means being disposed in immovable relation with said mandibular translation element and defining an internal actuator receptacle; and (b) said translation actuator includes an elongate actuator lever extending through said internal actuator receptacle and having a first end portion thereof in substantially pivotal relation with said maxillary translation element and an intermediate portion thereof in omnidirectional pivotal relation with said actuator housing means, said elongate actuator lever having a second end portion thereof adapted for translation controlling movement thereof.

18. The translator apparatus of claim 17, wherein:

(a) said elongate actuator lever having a spherical actuator component intermediate said first and second ends;

(b) said actuator housing defining internal support surfaces mounting said spherical actuator component for omnidirectional rotational motion within said actuator housing, (c) said maxillary translation element defining an actuator opening; and (d) said first end of said elongate actuator lever being located within said actuator opening and having a range of omnidirectional angular positioning relative to said maxillary translation element.

* * * * *